US009156180B2

(12) United States Patent
Horii et al.

(10) Patent No.: US 9,156,180 B2
(45) Date of Patent: Oct. 13, 2015

(54) PUNCHING MACHINE

(71) Applicant: Horizon International Inc., Shiga (JP)

(72) Inventors: Yoshiyuki Horii, Shiga (JP); Jun Mochizuki, Shiga (JP); Toyoki Takeuchi, Shiga (JP); Kou Ohuchiyama, Shiga (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 14/258,133

(22) Filed: Apr. 22, 2014

(65) Prior Publication Data

US 2014/0318338 A1 Oct. 30, 2014

(30) Foreign Application Priority Data

Apr. 25, 2013 (JP) ..... 2013-092321
Mar. 19, 2014 (JP) ..... 2014-056148

(51) Int. Cl.

| | |
|---|---|
| ***B26D 7/06*** | (2006.01) |
| ***B26D 7/18*** | (2006.01) |
| *B26D 5/00* | (2006.01) |
| *B26D 5/32* | (2006.01) |
| *B26F 1/38* | (2006.01) |

(52) U.S. Cl.

CPC ..... *B26D 7/18* (2013.01); *B26D 7/1818* (2013.01); *B26D 5/00* (2013.01); *B26D 5/32* (2013.01); *B26F 1/38* (2013.01); *B26F 1/384* (2013.01); *Y10T 83/2074* (2015.04)

(58) Field of Classification Search

CPC ..... B26D 2007/082; B26D 7/32; B26D 7/18; B26D 7/1818; B26D 5/00; B26F 1/38; B26F 1/384; Y10T 83/2074

USPC ..... 83/102, 102.1, 373, 370, 367, 360, 105, 83/106, 76.6, 149

See application file for complete search history.

(56) References Cited

U.S. PATENT DOCUMENTS

| | | | | |
|---|---|---|---|---|
| 3,764,085 | A * | 10/1973 | Hawkins | 242/526.3 |
| 4,985,012 | A * | 1/1991 | Marschke | 493/373 |
| 5,101,747 | A * | 4/1992 | Gerber | 112/470.13 |
| 5,488,887 | A * | 2/1996 | Kitamura | 83/407 |
| 5,826,474 | A * | 10/1998 | Howard et al. | 83/105 |
| 5,899,129 | A * | 5/1999 | Sumida et al. | 83/76.9 |
| 5,913,983 | A * | 6/1999 | Farmer | 134/9 |
| 6,092,452 | A * | 7/2000 | Adami | 83/428 |
| 6,817,274 | B1 | 11/2004 | Georgiades | |
| 6,874,396 | B2 * | 4/2005 | Sanda | 83/102 |
| 6,929,460 | B2 * | 8/2005 | McNamee | 425/216 |
| 7,107,888 | B2 * | 9/2006 | Blume et al. | 83/27 |
| 7,976,660 | B2 * | 7/2011 | Martin et al. | 156/117 |
| 2005/0061171 | A1 * | 3/2005 | Angelo | 101/226 |
| 2005/0274245 | A1 * | 12/2005 | Biggs et al. | 83/102 |
| 2010/0218458 | A1 * | 9/2010 | Benini et al. | 53/381.2 |

FOREIGN PATENT DOCUMENTS

| | | |
|---|---|---|
| EP | 0509443 | 10/1992 |
| JP | 2000-127097 | 5/2000 |

* cited by examiner

*Primary Examiner* — Omar Flores Sanchez
(74) *Attorney, Agent, or Firm* — Kirschstein, et al.

(57) ABSTRACT

Movable guides are moved in vertical direction by guide drive units between a retreating position and a protruding position. A setting section is provided for setting a contact start point on a sheet and a contact end point on the sheet. The movable guides are moved between the retreating position and the protruding position so as to keep contact with an area of the sheet from the contact start point to the contact end point while a product separated from the sheet is conveyed from a first conveying unit to a second conveying unit.

6 Claims, 8 Drawing Sheets

A

B

PUNCHING MACHINE

TECHNICAL FIELD

The present invention relates to a punching machine including a separating mechanism for separating a punched sheet into a product and a scrap.

BACKGROUND ART

A punching machine punches a sheet into a predetermined shape by means of a Thomson blade, a die cut roller or the like, thereby forming a product from the sheet. The sheet punched by the punching machine includes a scrap as well as the product. In order to obtain the product from the sheet, therefore, it is necessary to separate the punched sheet into the product and the scrap and remove the scrap away.

In a conventional punching process of sheets, sheets are punched in such a manner that some joints are left between a product and a scrap. A certain number of the punched sheets are stacked, and the products and the scraps are simultaneously separated from each other in the stack. When such an operation is performed by a worker, not only the serious burden is imposed on the workers because large force is required, but also the working efficiency is low. On the other hand, when such an operation is performed by a machine, the working efficiency is high but a size of the machine becomes large and the machine becomes complicated.

In addition, there is provided a punching machine including a separating mechanism for separating each of punched sheets into a product and a scrap while sequentially conveying the sheets one by one (see for example JP-A-2000-127097). The punching machine described in JP-A-2000-127097 blows air jet onto the punched sheet without joints between the product and the scrap so as to separate the product and the scrap and remove the scrap away while conveying the sheet along a conveying path.

Although the punching machine can reliably separate the product and the scrap in the case that the scrap is small or has a simple shape, it cannot separate the product and the scrap with the air jet completely in case that the scrap is large or has a complicated shape.

SUMMARY OF THE INVENTION

Problem to be Solved by the Invention

Accordingly, it is an object of the present invention to provide a punching machine having a separating mechanism capable of reliably separating a product and a scrap.

Means for Solving the Problem

In order to attain the object, a punching machine, comprising:

a die cut mechanism for punching a sheet into a predetermined shape to form a product from the sheet;

a separating mechanism for sequentially conveying the sheet punched by the die cut mechanism one by one along a conveying path, separating the sheet into the product and a scrap during the conveyance, and removing the scrap from the conveying path;

a control unit for controlling the separating mechanism; and an input unit for receiving input from an operator, the separating mechanism including:

first and second conveying units for conveying the sheet along the conveying path, the second conveying unit being disposed at a predetermined interval from a downstream end of the first conveying unit;

at least one movable guide disposed between the first conveying unit and the second conveying unit so as to separate the product and the scrap and guide the scrap out of the conveying path; and a guide drive unit for moving the at least one movable guide in a vertical direction between a retreating position where the at least one movable guide retreats upward from the conveying path and a protruding position where the at least one movable guide protrudes into the conveying path, the input unit including a setting section for setting a contact start point on the sheet where the at least one movable guide is started to come in contact with the sheet and a contact end point on the sheet where the at least one movable guide is started to separate from the sheet, the input unit further transmitting the information set by the setting section to the control unit, the separating mechanism being controlled by the control unit based on at least the information set by the setting section so that the at least one movable guide moves from the retreating position to the protruding position to contact with the contact start point on the sheet, and then moves from the protruding position to the retreating position to separate from the contact end point on the sheet, while the sheet is conveyed from the first conveying unit to the second conveying unit.

Preferably, a plurality of the movable guides are disposed side by side in a direction perpendicular to the conveying direction of the sheet, a pair of the contact start point and the contact end point can be separately set for each of the movable guides, and the separating mechanism is controlled by the control unit so that each of the movable guides moves from the retreating position to the protruding position to contact with the contact start point on the sheet, and then moves from the protruding position to the retreating position to separate from the contact end point on the sheet, while the sheet is conveyed from the first conveying unit to the second conveying unit.

Preferably, a plurality of the movable guides are disposed side by side in a direction perpendicular to the conveying direction of the sheet, and a position of each of the movable guides can be changed in the perpendicular direction.

Preferably, pairs of the contact start point and the contact end point can be set for the movable guide or the respective movable guides, and the separating mechanism is controlled by the control unit so that the at least one movable guide moves to contact with the contact start points on the sheet and separate from the contact end points on the sheet while the sheet is conveyed from the first conveying unit to the second conveying unit.

Preferably, the setting of the contact start point is performed by inputting a distance from a leading end of the sheet to the contact start point and the setting of the contact end point is performed by inputting a distance from the leading end of the sheet to the contact end point.

Preferably, the punching machine further includes a sheet detector disposed upstream of the movable guide so as to detect a passage of the sheet and send a detection signal to the control unit, the control unit controlling the separating mechanism based on at least the detection signal and the information set by the setting section.

Effect of the Invention

According to the present invention, at least one movable guide for separating the sheet into the product and the scrap is moved upward and downward between the retreating position and the protruding position. The input unit for receiving the input from the operator includes the setting section for setting the contact start point on the sheet and the contact end point on the sheet. The control unit controls the separating mechanism in such a manner that the at least one movable guides keeps contacting with an area of the sheet from the contact start point to the contact end point.

In other words, according to the punching machine of the present invention, the operator can freely set a timing for moving the at least one movable guide relative to the travelling sheet. Consequently, the operator can select the area of the sheet with which the at least one movable guide contacts corresponding to the shape of the product and the scrap. As a result, even if the scrap is large or has a complicated shape, the product and the scrap are reliably separated from each other.

MODE FOR CARRYING OUT THE INVENTION

Figure 1:
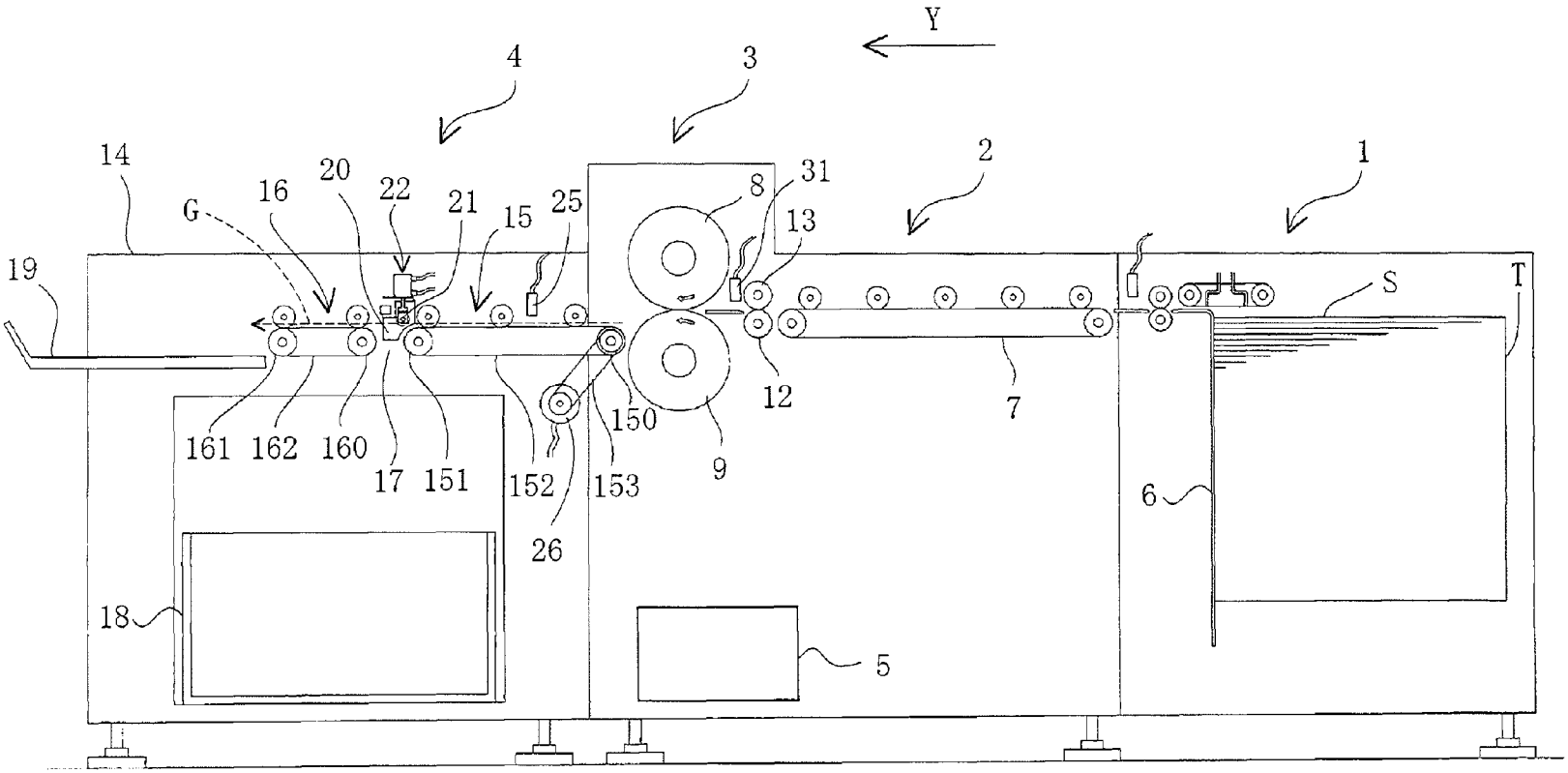
FIG. 1 is a side view schematically showing a configuration of a punching machine according to the present invention.

A punching machine according to the present invention will be described below with reference to the accompanying drawings. With reference to FIG. 1, a punching machine includes a sheet feeding mechanism 1 for feeding sheets S one by one, a sheet conveying mechanism 2 for sequentially conveying the sheets S fed from the sheet feeding mechanism 1 in a conveying direction Y, and a die cut mechanism 3 for punching the sheet S conveyed from the sheet conveying mechanism 2 into a predetermined shape. The punching machine further includes a separating mechanism 4. The separating mechanism 4 separates the sheet S into a product P and a scrap Q (see FIG. 2) while conveying the sheet S punched by the die cut mechanism 3 in the conveying direction Y along a conveying path G, and removes the scrap Q from the conveying path G. Furthermore, the punching machine includes a control unit 5 for controlling the sheet feeding mechanism 1, the sheet conveying mechanism 2, the die cut mechanism 3 and the separating mechanism 4.

The sheet feeding mechanism 1 includes a shelf 6 on which a sheet stack T is placed. The sheet feeding mechanism 1 sequentially feeds the uppermost sheet S of the sheet stack T. The sheet conveying mechanism 2 includes a belt conveyer 7 for delivering the sheet S to the die cut mechanism 3.

Figure 2:
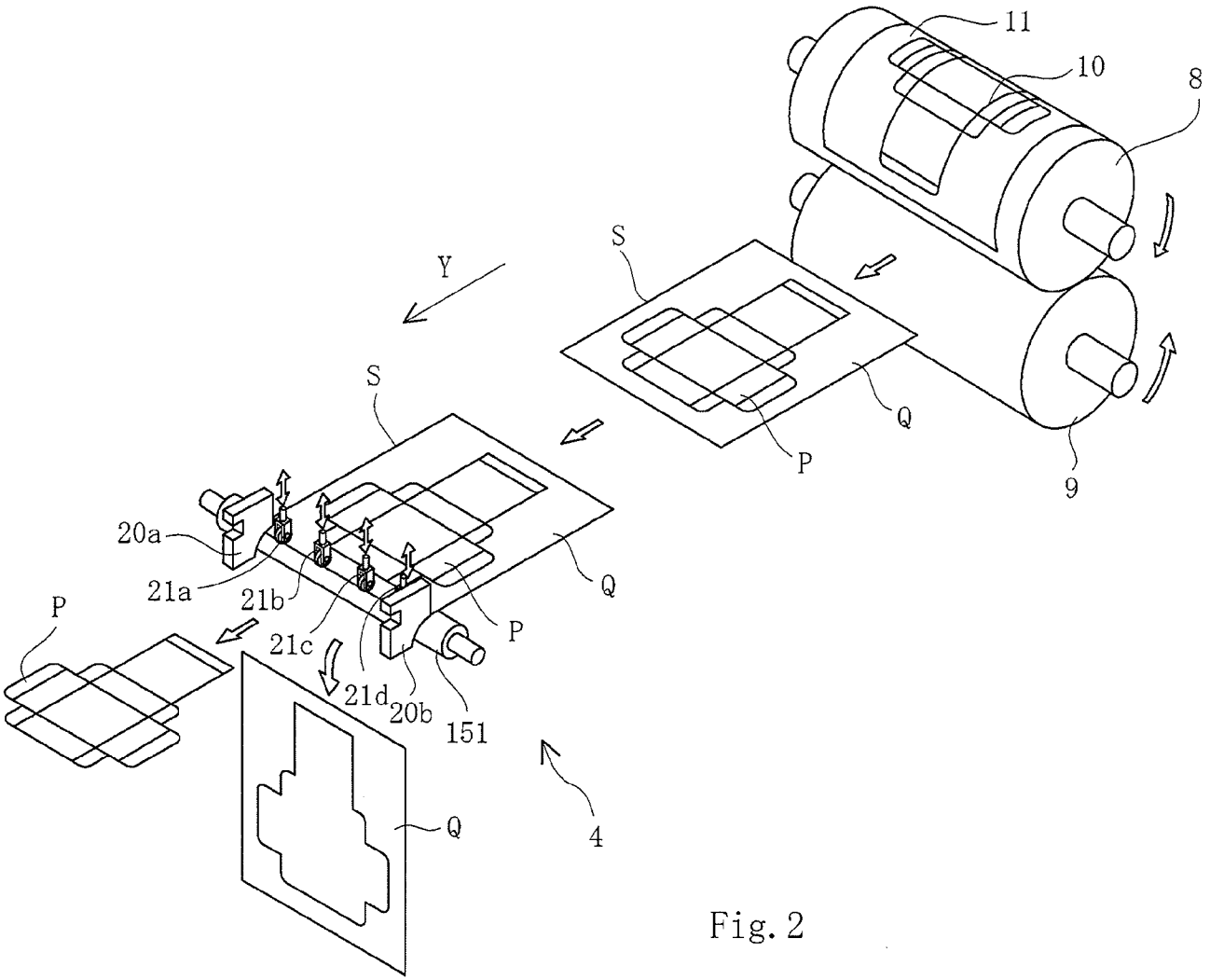
FIG. 2 is a perspective view schematically showing a situation in which a punched sheet is separated into a product and a scrap.

With reference to FIGS. 1 and 2, the die cut mechanism 3 includes a pair of a die cut roller 8 and an anvil roller 9. The die cut roller 8 and the anvil roller 9 extend to a direction perpendicular to the conveying direction Y and parallel to each other. And the die cut roller 8 and the anvil roller 9 are arranged opposite to each other in a vertical direction with a gap therebetween. The die cut roller 8 includes a sheet-like flexible die 11 having a punching blade 10 formed thereon as shown in FIG. 2. A magnet (not shown) is buried in a periphery of the die cut roller 8, and the flexible die 11 is mounted on the die cut roller 8 by means of the magnetic force of the magnet. The die cut roller 8 and the anvil roller 9 are rotated in synchronization with each other by means of a driving unit (not shown).

As shown in FIG. 1, the die cut mechanism 3 includes a conveying roller pair consisting of a driving roller 12 and an idle roller 13 arranged opposite to each other in a vertical direction. The conveying rollers 12 and 13 are arranged upstream of the die cut roller 8 and the anvil roller 9. The sheet S from the sheet conveying mechanism 2 is conveyed between the conveying rollers 12 and 13, and then conveyed between the die cut roller 8 and the anvil roller 9.

While the die cut roller 8 and the anvil roller 9 are rotated, the sheet S is conveyed by the conveying rollers 12 and 13 between the die cut roller 8 and the anvil roller 9. Consequently, as shown in FIG. 2, the sheet S is punched into a predetermined shape by means of the punching blade 10 so that the product P and the remaining scrap Q are formed from the sheet S. Preferably, the punching blade 10 punches the sheet S so that some joints are left between the product P and the scrap Q, thereby preventing the product P and the scrap Q from being shifted with each other until they are conveyed to the separating mechanism 4. If the product P and the scrap Q are rarely shifted with each other, the punching blade 10 may punch the sheet S so that no joint is left between the product P and the scrap Q.

As shown in FIG. 1, the separating mechanism 4 includes a frame 14 having the conveying path G along which the sheet S is conveyed, and a first conveying unit 15 and a second conveying unit 16 for conveying the sheet S punched by the die cut mechanism 3 along the conveying path G.

Each of the first conveying unit 15 and the second conveying unit 16 consists of a belt conveyor extending along the conveying path G. The first conveying unit 15 includes a pair of pulleys 150 and 151 whose shafts extend to a direction perpendicular to the conveying direction Y, an endless belt 152 extending between the pulleys 150 and 151, and a motor (not shown) which is coupled to the shaft of the pulley 150 and circulates the endless belt 152. The second conveying unit 16 has the same structure as the first conveying unit 15 and includes a pair of sprockets 160 and 161, an endless belt 162 and a motor (not shown). The second conveying unit 16 is disposed at a predetermined interval from a downstream end of the first conveying unit 15 so that a clearance 17 is formed between the downstream end of the first conveying unit 15 and an upstream end of the second conveying unit 16.

The separating mechanism 4 includes a scrap receiving box 18 disposed below the clearance 17 so as to receive the scrap Q removed from the conveying path G through the clearance 17, and a tray 19 disposed at a downstream end of the conveying path G so as to receive the conveyed product P.

As shown in FIG. 2, the separating mechanism 4 includes two fixed guides 20*a* and 20*b* and four movable guides 21*a* to 21*d*. As shown in FIG. 1, both of the fixed guide 20 and the movable guide 21 are disposed between the first conveying unit 15 and the second conveying unit 16 so as to separate the product P and the scrap Q and guide the scrap Q out of the conveying path G (the reference numeral 20 is used for collectively representing the respective fixed guides 20*a* and 20*b*, and the reference numeral 21 is used for collectively representing the respective movable guides 21*a* to 21*d*. The same applies hereinafter). A guide drive unit 22 is provided for each of the movable guides 21*a* to 21*d*. The guide drive unit 22 moves the movable guide 21 in a vertical direction.

Figure 3:
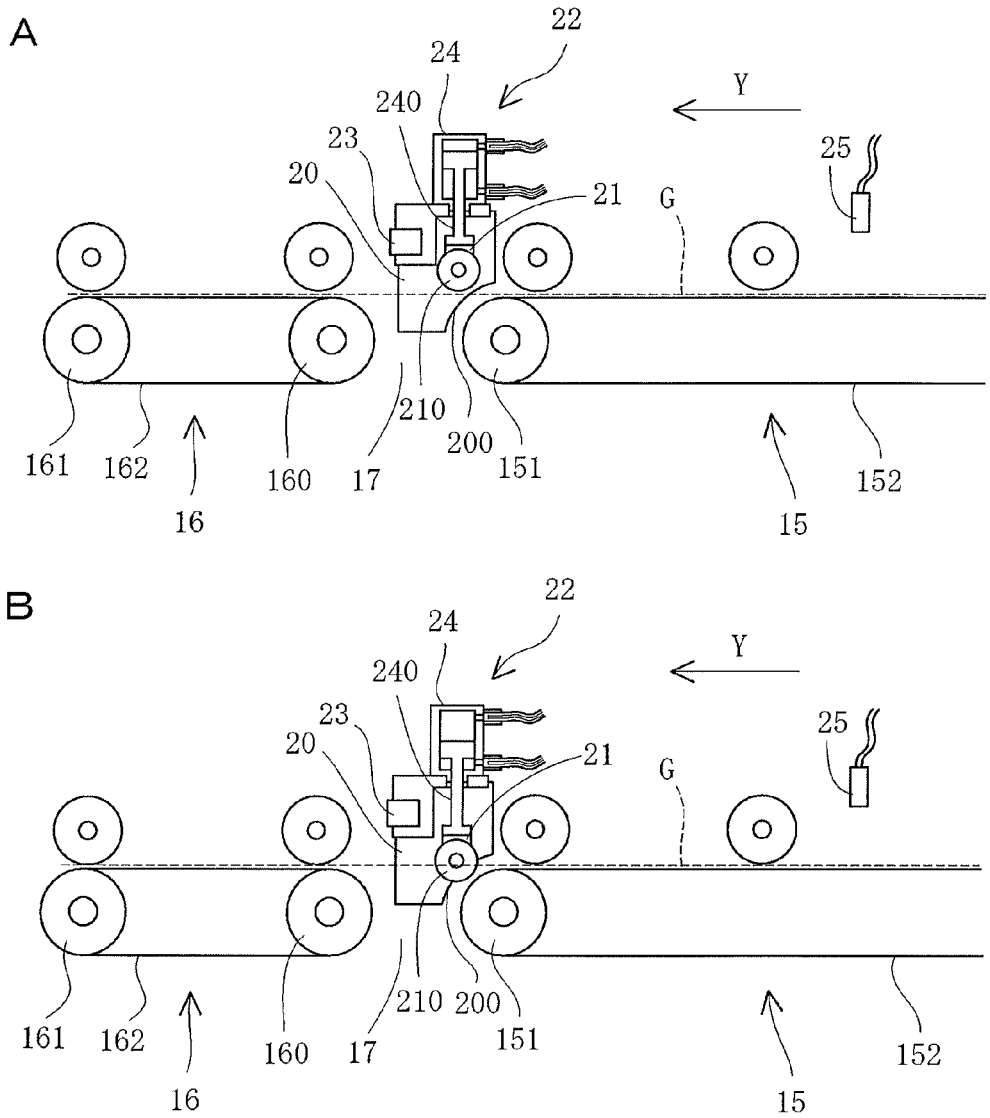
FIGS. 3A and 3B are side views showing a main part of a separating mechanism of the punching machine according to the present invention.

As shown in FIGS. 3A and 3B, an attachment member 23 extends perpendicularly to the conveying direction Y and is supported by the frame 14 (FIG. 1). The fixed guide 20 is attached to the attachment member 23 and is disposed on the conveying path G. An arcuate guide surface 200 of the fixed guide 20 is opposed to a leading end of the sheet S travelling in the conveying direction Y.

The movable guide 21 includes a roller 210 having a shaft extending perpendicularly to the conveying direction Y. The guide drive unit 22 includes an air cylinder 24 having a piston rod 240, and an air supply source (not shown) for supplying air to the air cylinder 24 to reciprocate the piston rod 240. The air cylinder 24 is attached to the attachment member 23 in such a manner that the piston rod 240 faces downward. The movable guide 21 is attached to a tip of the piston rod 240. The guide drive unit 22 moves the movable guide 21 (the roller 210) in the vertical direction by means of the piston rod 240 between a retreating position and a protruding position. At the retreating position, as shown in FIG. 3A, the movable guide 21 retreats upward from the conveying path G so as not to contact with the sheet S travelling along the conveying path G. At the protruding position, as shown in FIG. 3B, the movable guide 21 protrudes into the conveying path G so as to contact with the sheet S travelling along the conveying path G.

In this embodiment, as shown in FIG. 2, the two fixed guides 20*a* and 20*b* are disposed side by side in a direction perpendicular to the conveying direction Y. The respective fixed guides 20*a* and 20*b* are attached to the attachment member 23 (FIGS. 3A and 3B) so as to slide along the attachment member 23. Thus, a position of each of the fixed guides 20*a* and 20*b* can be changed in the perpendicular direction. The four movable guides 21*a* to 21*d* are disposed side by side in the perpendicular direction. The air cylinder 24 (FIGS. 3A and 3B) is provided for each of the movable guides 21*a* to 21*d* and the movable guides 21*a* to 21*d* are individually moved upward and downward. Each air cylinder 24 is slidably attached to the attachment member 23. A position of each of the movable guides 21*a* to 21*d* can be changed in the perpendicular direction by the slide movement of the air cylinder 24.

The separating mechanism 4 separates the sheet S into the product P and the scrap Q by means of the fixed guides 20*a* and 20*b* and the movable guides 21*a* to 21*d* while the sheet S is conveyed from the first conveying unit 15 to the second conveying unit 16.

With reference to FIG. 1 again, the punching machine includes a sensor 25 for detecting the passage of the sheet S. The sensor 25 is disposed upstream of the movable guide 21. The sensor 25 is for example a photoelectric sensor. In this embodiment, the sensor 25 is disposed above the first conveying unit 15 and faces to the conveying path G. The sensor 25 detects the passage of the leading end of the sheet S. Moreover, a rotary encoder 26 is connected to the shaft of the pulley 150 of the first conveying unit 15 through a transmission belt 153.

Figure 4:
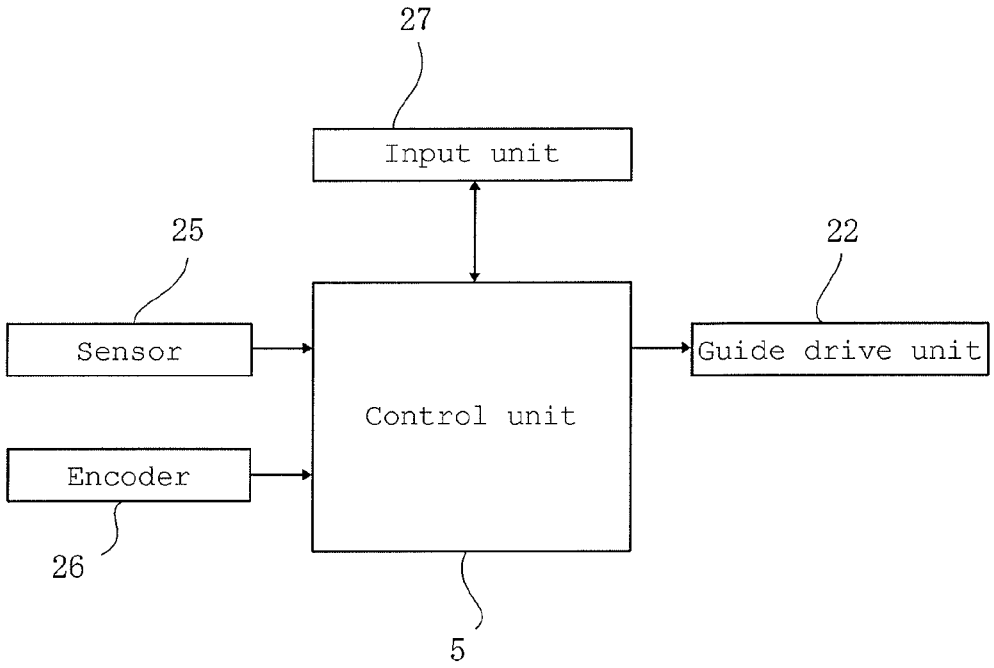
FIG. 4 is a block diagram of the punching machine according to the present invention.

FIG. 4 is a block diagram of the punching machine. The sensor 25 and the encoder 26 are connected to the control unit 5. The control unit 5 receives detection signals from the sensor 25 and pulses outputted from the encoder 26. The guide drive unit 22 is controlled by the control unit 5. Furthermore, the punching machine includes an input unit 27 for receiving input from an operator. The control unit 5 receives the input from the input unit 27.

Figure 5:
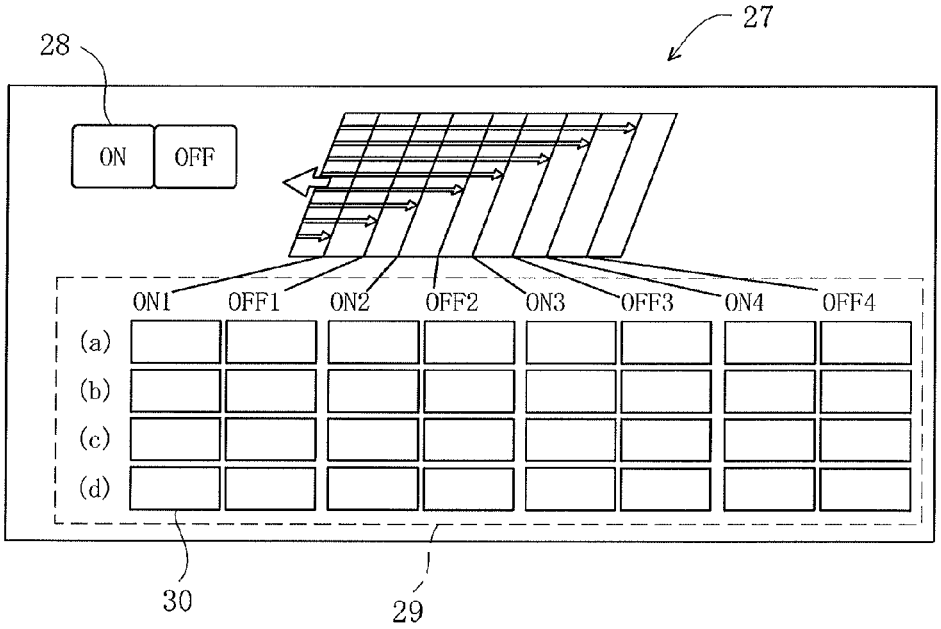
FIG. 5 is a plan view showing an input screen displayed on the display of the input unit.

As shown in FIG. 5, the input unit 27 includes a touch panel display provided with a pair of "on" and "off" buttons 28 displayed thereon for switching operation and non-operation of the movable guides 21*a* to 21*d*. The operator presses the "ON" button so as to operate the movable guides 21*a* to 21*d*, and presses the "OFF" button so as not to operate the movable guides 21*a* to 21*d*. The input unit 27 includes a sheet size input section (not shown) for inputting a size of the sheet S.

Moreover, the input unit 27 includes a setting section 29 for setting contact start points on the sheet S where each of the movable guides 21*a* to 21*d* is started to come in contact with the travelling sheet S and contact end points on the sheet S where each of the movable guides 21*a* to 21*d* is started to separate from the travelling sheet S. By the setting section 29, the operator can set contact areas of the sheet S to be conveyed for each of the movable guides 21*a* to 21*d*.

The setting section 29 includes a matrix of input areas 30. The rows (a) to (d) correspond to the movable guides 21*a* to 21*d*, respectively. Each of the input areas 30 of the "ON1" column is used for setting the contact start point, and each of the input areas 30 of the "OFF1" column is used for setting the contact end point. The "ON2" to "OFF4" columns are also the same. Thus, the pairs of the contact start point and the contact end point can be set through the setting section 29 for each of the movable guides 21*a* to 21*d*. Consequently, each of the movable guides 21*a* to 21*d* can contact with the sheet S a plurality of times (four times in this embodiment) while the sheet S is conveyed.

In this embodiment, the setting of each of the contact start points is performed by inputting to the respective corresponding input areas 30 of the "ON1" to "ON4" columns a distance in the conveying direction Y from the leading end of the sheet S to the contact start point. Furthermore, the setting of each of the contact end points is performed by inputting to the respective corresponding input areas 30 of the "OFF1" to "OFF4" columns a distance in the conveying direction Y from the leading end of the sheet S to the contact end point.

For example, In case that the product P shown in FIG. 6A is formed, it is necessary to contact each of the movable guides 21*a* to 21*d* with the areas of the scrap Q (for example, areas extending from point $C_1$ to point $D_1$ and areas extending from point $C_2$ to point $D_2$ of the scrap Q drawn by dashed lines) in order to remove the scrap Q from the conveying path G. In this case, distances $L_1$, $L_4$ and $L_5$ from the leading end of the sheet S to the contact start point $C_1$ and $C_2$ and distances $L_2$, $L_3$ and $L_6$ from the leading end of the sheet S to the contact end point $D_1$ and $D_2$ are previously and actually measured for each of the movable guides 21*a* to 21*d* by the operator. As shown in FIG. 6B, the measured distances $L_1$ to $L_6$ are inputted to the respective corresponding input areas 30 by the operator. Thereby, the pairs of the contact start point $C_1$ and $C_2$ and the contact end point $D_1$ and $D_2$ are set. The input unit 27 transmits to the control unit 5 the information set by the setting unit 29. In this case, the input areas 30 of the "ON3" to "OFF4" columns are not used for the setting.

The separating mechanism 4 are controlled by the control unit 5 based on the detection signals from the sensor 25, the pluses from the encoder 26 and the information set by the setting section 29. With reference to FIG. 7A, the travelling distance of the sheet S from the sensor 25 to the movable guide 21 is known. When the sensor 25 detects the passage of the leading end of the sheet S travelling in the conveying direction Y, the sensor 25 sends the detection signal to the control unit 5. The encoder 26 (FIG. 1) constantly detects the rotation of the pulley 150 of the first conveying unit 15 and sends the pluses to the control unit 5. Thus, the control unit 5 can detect a speed V and a position of the sheet S conveyed by the first conveying unit 15. The movable guide 21 is moved upward and downward by the guide drive unit 22 relative to the travelling sheet S at a timing determined based on the speed V and the position of the sheet S.

Figure 6:
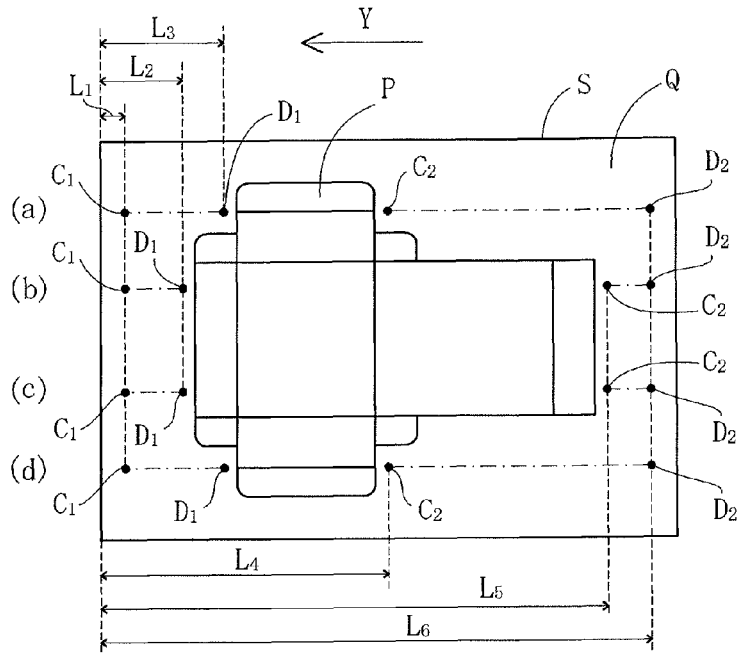
FIG. 6A is a view showing an example of a sheet to be separated into a product and a scrap by the separating mechanism.
FIG. 6B is a view showing an example of the information inputted through the input screen corresponding to the sheet shown in FIG. 6A.
Figure 6:
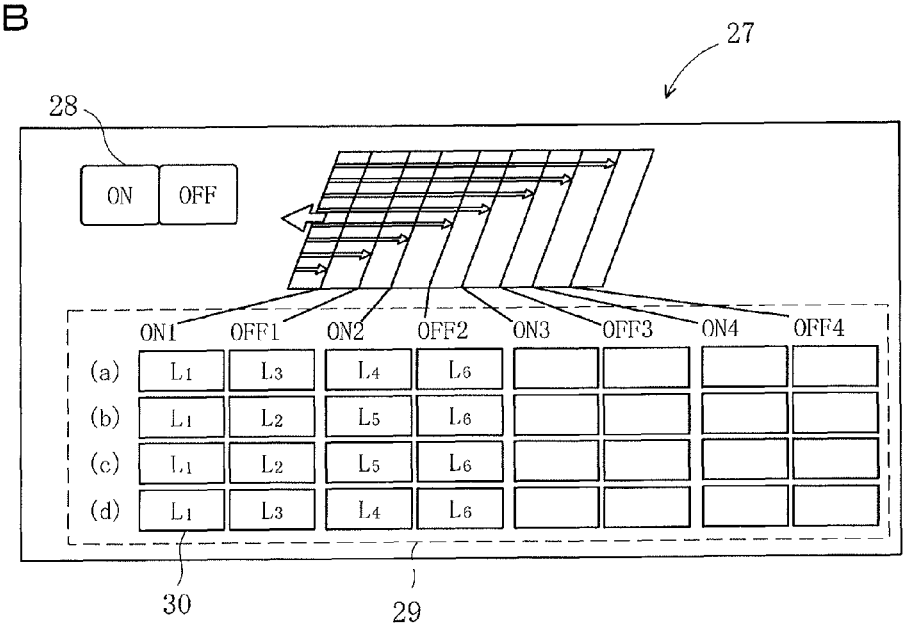
Figure 7:
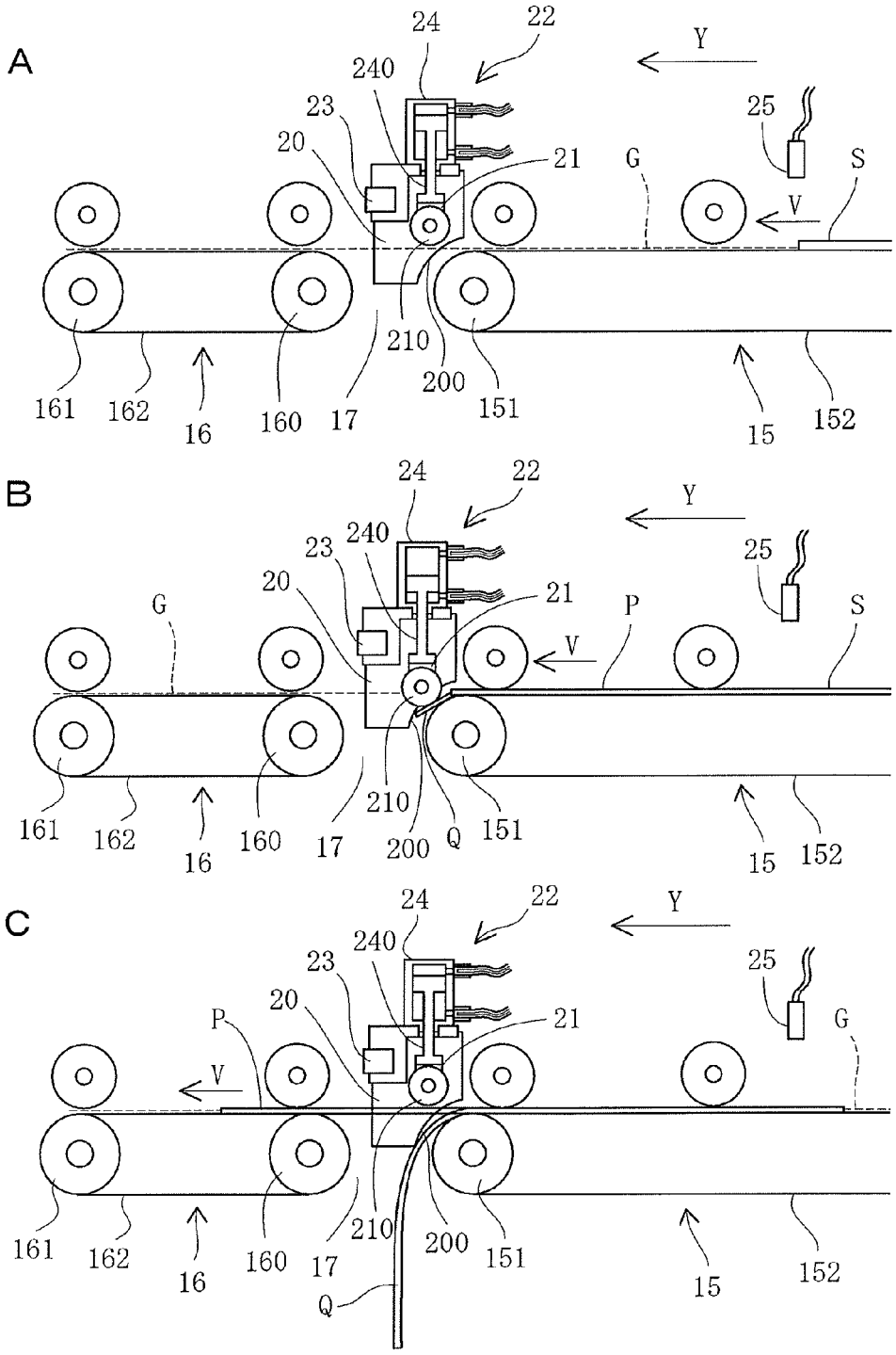
FIGS. 7A to 7C are side views showing a situation in which the separating mechanism shown in FIGS. 3A and 3B separates the sheet into the product and the scrap.

As shown in FIG. 7B, the separating mechanism 4 is controlled by the control unit 5 so that the movable guide 21 (the roller 210) moves downward from the retreating position to the protruding position to contact with the contact start point $C_1$ (FIG. 6A) on the sheet while the sheet S is conveyed from the first conveying unit 15 to the second conveying unit 16. And then, the movable guide 21 moves upward from the protruding position to the retreating position to separate from the contact end point $D_1$ (FIG. 6A) on the sheet S as shown in FIG. 7. As a result, the movable guide 21 keeps contacting with an area of the sheet S from the contact start point $C_1$ to the contact end point $D_1$ during the conveyance.

When the pairs of the contact start point $C_1$ and $C_2$ and the contact end point $D_1$ and $D_2$ are set, the movable guide 21 further moves to contact with the next contact start point $C_2$ on the sheet S after the first contact operation. Thereafter, the movable guides 21 moves to separate from the next contact end point $D_2$ on the sheet S, thereby ending the second contact operation. Such operation is repeated while the sheet S is conveyed from the first conveying unit 15 to the second conveying unit 16:

In this embodiment, the pairs of the contact start point $C_1$ and $C_2$ and the contact end point $D_1$ and $D_2$ are individually set for each of the movable guides 21*a* to 21*d*. Each of the movable guides 21*a* to 21*d* moves separately downward from the retreating position to the protruding position to contact with the contact start points $C_1$ and $C_2$ on the sheet S. Thereafter, each of movable guides 21*a* to 21*d* moves separately upward from the protruding position to the retreating position to separate from the contact end points $D_1$ and $D_2$ on the sheet S. The above mentioned operation is performed for the sheets S sequentially conveyed from the first conveying unit 15 to the second conveying unit 16.

In the case that the pairs of the contact start point $C_1$ and $C_2$ and the contact end point $D_1$ and $D_2$ are set as shown in FIG. 6, the movable guide 21 (the roller 210) first contacts with the front side (that is the area from point $C_1$ to point $C_2$) of the scrap Q so that the scrap Q is pushed downward as shown in FIG. 7B. At this time, moreover, the leading end of the scrap Q also contacts with the guide surface 200 of the fixed guide 20 which is positioned on the conveying path G without interrupting the product P. Thus, the product P and the front side of the scrap Q are separated from each other and the scrap Q is guided out of the conveying path G. Thereafter, the movable guide 21 contacts with a rear side (that is the area from point $C_2$ to point $D_2$) of the scrap Q so that the product P and the rear side of the scrap Q are separated from each other. In the case that the sheet S is punched so that some joints are left between the product P and the scrap Q, all of the joints are cut during the separation by the fixed guide 20 and the movable guide 21. As shown in FIG. 7C, the product P is conveyed to the second conveying unit 16 and then is discharged to the tray 19, and the scrap Q is removed from the conveying path G and falls into the scrap receiving box 18 through the clearance 17.

Figure 8:
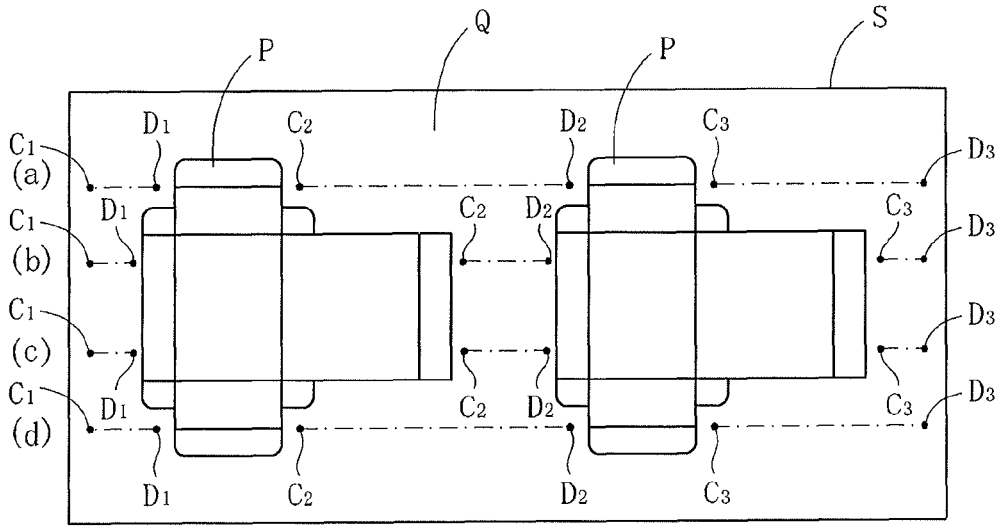
FIG. 8 is a view showing another example of the sheet to be separated into the products and the scrap by the separating mechanism.

According to the separating mechanism 4, when a plurality of products P are formed from the sheet S as shown in FIG. 8, it is possible to reliably separate the products P and the scrap Q by setting the pairs of the contact start point $C_1$ to $C_3$ and the contact end point $D_1$ to $D_3$ as in FIG. 8.

As described above, according to the punching machine in accordance with the present invention, the operator can freely set the timing for moving the movable guides 21*a* to 21*d* in the vertical direction relative to the travelling sheet S. Consequently, the operator can select the areas of the sheet with which the movable guides 21*a* to 21*d* contact corresponding to the shape of the product and the scrap. As a result, even if the scrap Q is large or has a complicated shape, the product P and the scrap Q are reliably separated from each other.

Further, the movable guides 21*a* to 21*d* move upward and downward to contact with the sheet S a plurality of times while the sheet S is conveyed from the first conveying unit 15 to the second conveying unit 16. The position of each of the movable guides 21*a* to 21*d* can be changed in the direction perpendicular to the conveying direction Y. In addition, the pairs of the contact start point and the contact end point can be set for each of the movable guides 21*a* to 21*d*, and the movable guides 21*a* to 21*d* individually moves upward and downward. Therefore, the product P and the scrap Q can be separated still more reliably.

Although the preferred embodiment of the present invention has been described above, the present invention is not restricted to the embodiment. Although in the above mentioned embodiment the movable guide 21 includes the roller 210 in order to guide the scrap Q out of the conveying path G, the movable guide 21 may include a guide surface having the same structure as the guide surface 200 of the fixed guide 20. Moreover, although in the above mentioned embodiment the guide drive unit 22 includes the air cylinder 24 in order to move the movable guide 21 in the vertical direction, the guide drive unit 22 may include another linear actuator such as an electromagnetic solenoid.

The sheet detector may be a mark detector for detecting a mark provided on the sheet S instead of the sensor 25. The mark detector reads the mark on the sheet S to detect the passage of the sheet S. For example, the mark detector is a transmission type photoelectric sensor for reading the mark based on light transmittance or a bar code reader for reading a bar code on the sheet S. Preferably, the mark is provided on the scrap Q of the sheet S.

The sheet detector may be a camera for imaging contents printed on the sheet S. Images of a part of the conveying path G are obtained by the camera at regular intervals and sent to the control unit 5. In the control unit 5, the predetermined image processing is performed to determine whether the printed contents are included in the image or not, and thereby the passage of the sheet S is detected based on the result of the determination.

In order to avoid detection errors, at least two of the sensors 25, the mark detectors, and the cameras may be used together.

If the sheet detector is disposed upstream of the movable guide 21, it does not need to be provided above the first conveying unit 15. For example, as shown in FIG. 1, a sensor 31 is provided upstream of the die cut roller 8 and the anvil roller 9. The sensor 31 detects the passage of the leading end of the sheet S. The die cut mechanism 3 punches the sheet S at a timing determined based on the detection signals from the sensor 31. The sensor 31 may function as the sheet detector.

In this case, the movable guide 21 moves upward and downward at the timing determined based on the detection signals from the sensor 31, the speed of the sheet S conveyed by the conveying rollers 12 and 13, the speed V of the sheet S conveyed by the first conveying unit 15, and the travelling distance of the sheet S from the sensor 31 to the movable guide 21. The sensor 31 may be replaced with the mark detector or the camera. In order to move the movable guide 21 at the more accurate timing, the sheet detector is preferably disposed close to the movable guide 21.

In the above mentioned embodiment, as shown in FIG. 1, although the control unit 5 detects the speed V of the sheet S based on pluses outputted from the encoder 26 connected to the first conveying unit 15, the control unit 5 may detects the speed V of the sheet S based on outputted signals from a servo motor as the motor for driving the first conveying unit 15.

1 Sheet feeding mechanism
2 Sheet conveying mechanism
3 Die cut mechanism
4 Separating mechanism
5 Control unit
15 First conveying unit
16 Second conveying unit
21 Movable guide
22 Guide drive unit
25 Sensor (sheet detector)
27 Input unit
29 Setting section
C1, C2, C3 Contact start point
D1, D2, D3 Contact end point
G Conveying path
P Product
Q Scrap
S Sheet
T Sheet stack
Y Conveying direction

The invention claimed is:

1. A punching machine, comprising:

a die cut mechanism for punching a sheet into a predetermined shape to form a product from the sheet;

a separating mechanism for sequentially conveying the sheet punched by the die cut mechanism one by one along a conveying path, separating the sheet into the product and a scrap during the conveyance, and removing the scrap from the conveying path;

a control unit for controlling the separating mechanism; and an input unit for receiving input from an operator, the separating mechanism including:

a first conveying unit for conveying the sheet along the conveying path;

a second conveying unit for conveying the product along the conveying path, the second conveying unit being disposed at a predetermined interval from a downstream end of the first conveying unit;

at least one movable guide disposed between the first conveying unit and the second conveying unit so as to separate the product and the scrap and guide the scrap out of the conveying path; and a guide drive unit for moving the at least one movable guide in a vertical direction between a retreating position where the at least one movable guide retreats upward from the conveying path and a protruding position where the at least one movable guide protrudes into the conveying path, the input unit including a setting section for setting a contact start point on the sheet where the at least one movable guide is started to come in contact with the sheet and a contact end point on the sheet where the at least one movable guide is started to separate from the sheet, the input unit further transmitting the information set by the setting section to the control unit, the separating mechanism being controlled by the control unit based on at least the information set by the setting section so that the at least one movable guide moves from the retreating position to the protruding position to contact with the contact start point on the sheet, and then moves from the protruding position to the retreating position to separate from the contact end point on the sheet, while the product is conveyed to the second conveying unit.

2. The punching machine according to claim 1, wherein a plurality of the movable guides are disposed side by side in a direction perpendicular to the conveying path of the sheet, a pair of the contact start point and the contact end point can be separately set for each of the movable guides, and the separating mechanism is controlled by the control unit so that each of the movable guides moves from the retreating position to the protruding position to contact with the contact start point on the sheet, and then moves from the protruding position to the retreating position to separate from the contact end point on the sheet, while the product is conveyed to the second conveying unit.

3. The punching machine according to claim 1, wherein a plurality of the movable guides are disposed side by side in a direction perpendicular to the conveying path of the sheet, and a position of each of the movable guides can be changed in the perpendicular direction.

4. The punching machine according to claim 1, wherein pairs of the contact start point and the contact end point can be set for the movable guide or the respective movable guides, and the separating mechanism is controlled by the control unit so that the at least one movable guide moves to contact with the contact start points on the sheet and separate from the contact end points on the sheet while the product is conveyed to the second conveying unit.

5. The punching machine according to claim 1, wherein the setting of the contact start point is performed by inputting a distance from a leading end of the sheet to the contact start point and wherein the setting of the contact end point is performed by inputting a distance from the leading end of the sheet to the contact end point.

6. The punching machine according to claim 1, further comprising a sheet detector disposed upstream of the at least one movable guide so as to detect a passage of the sheet and send a detection signal to the control unit, the control unit controlling the separating mechanism based on at least the detection signal and the information set by the setting section.

* * * * *